US007216933B2

(12) United States Patent
Schmidt et al.

(10) Patent No.: US 7,216,933 B2
(45) Date of Patent: May 15, 2007

(54) BACKREST, PARTICULARLY FOR AN OFFICE CHAIR

(75) Inventors: Christopher Schmidt, Nürnberg (DE); Armin Sander, Hochstrasse 15a, Nürnberg (DE) D-90429

(73) Assignee: Armin Sander, Nürnberg (DE)

( * ) Notice: Subject to any disclaimer, the term of this patent is extended or adjusted under 35 U.S.C. 154(b) by 68 days.

(21) Appl. No.: 11/061,565

(22) Filed: Feb. 18, 2005

(65) Prior Publication Data

US 2005/0184568 A1 Aug. 25, 2005

(30) Foreign Application Priority Data

Feb. 21, 2004 (DE) ..... 20 2004 002 777 U

(51) Int. Cl.
*A47C 7/46* (2006.01)

(52) U.S. Cl. ..... 297/284.4

(58) Field of Classification Search ..... 297/284.4
See application file for complete search history.

(56) References Cited

U.S. PATENT DOCUMENTS 3,951,451 A * 4/1976 Srock ..... 297/366
4,452,485 A * 6/1984 Schuster ..... 297/284.4
4,627,661 A * 12/1986 Ronnhult et al. ..... 297/284.4
5,397,164 A * 3/1995 Schuster et al. ..... 297/284.1
5,651,584 A * 7/1997 Chenot et al. ..... 297/284.4
5,769,490 A * 6/1998 Falzon ..... 297/284.4
5,975,634 A * 11/1999 Knoblock et al. ..... 297/300.4
6,254,186 B1 7/2001 Falzon
6,378,942 B1 * 4/2002 Chu ..... 297/284.4
6,616,228 B2 * 9/2003 Heidmann ..... 297/284.4
6,758,522 B2 * 7/2004 Ligon et al. ..... 297/284.4
6,805,405 B2 * 10/2004 Koo ..... 297/284.7
6,860,559 B2 * 3/2005 Schuster et al. ..... 297/284.1
6,863,346 B2 * 3/2005 Zund ..... 297/322
6,918,634 B2 * 7/2005 Elliot ..... 297/284.4

* cited by examiner

*Primary Examiner*—Peter M. Cuomo
*Assistant Examiner*—Tania Abraham
(74) *Attorney, Agent, or Firm*—Laurence A. Greenberg; Werner H. Stemer; Ralph E. Locher

(57) ABSTRACT

In the case of a backrest (1), in particular for an office chair, having a lordosis support (3) comprising supporting ribs (2) arranged in a manner such that they run parallel to one another, said supporting ribs are precurved in a flexurally elastic manner in their starting position. An adjusting element (9), which can be actuated via an adjusting member (6) and is intended for setting the lordosis curvature (18), is guided on the curvature side (12) of the lordosis support (3) in such a manner that the lordosis curvature (18) decreases during a tensile loading of the adjusting element (9).

12 Claims, 4 Drawing Sheets

BACKREST, PARTICULARLY FOR AN OFFICE CHAIR

BACKGROUND OF THE INVENTION

FIELD OF THE INVENTION

The invention relates to a backrest having a lordosis support comprising supporting ribs arranged in a manner such that they run parallel to one another, and having an adjusting element, which can be actuated via an adjusting member and is intended for setting the lordosis curvature. It furthermore relates to a chair, in particular an office chair, having a backrest of this type and a seat surface which is movable synchronously thereto.

DE 29 47 472 C2 discloses a backrest, in particular for a motor vehicle seat, which has a lordosis support with a number of supporting ribs. The lordosis support is fitted into a backrest frame by means of spring elements and can be set with regard to its lordosis curvature by means of an adjusting member. For this purpose adjusting elements, which can be actuated by the adjusting member, on the rear side of the backrest, which side faces away from a backrest cushion, engage on the lordosis support in the manner of a bowstring. Actuation of the adjusting member causes the adjusting elements to be subjected to a tensile load in such a manner that the lordosis curvature increases as a consequence of the adjusting elements decreasing in length.

SUMMARY OF THE INVENTION

The invention is based on the object of specifying a backrest having a particularly suitable lordosis support. Furthermore, a chair having a backrest of this type and a particularly suitable synchronizing mechanism is to be specified.

With regard to the backrest, the abovementioned object is achieved according to the invention by the features of claim 1. For this purpose, the supporting ribs are precurved in a flexurally elastic manner in their starting position. The adjusting element is guided on the curvature side of the lordosis support, which side faces a cushion side of the backrest, in such a manner that the lordosis curvature decreases during a tensile loading of the adjusting element. The tensile loading of the adjusting element by means of the adjusting member therefore causes the backrest in the lordosis region to be increasingly straightened out starting from the maximum possible lordosis curvature in the starting position.

According to one particularly preferred variant, the supporting ribs are an integral part of a backrest shell which extends over at least a substantial part of the backrest. A number of horizontal longitudinal slots have been made in the lordosis region of this backrest shell, forming the supporting ribs. In this case, the backrest shell expediently consists of a synthetic material, with, as a consequence of it being weakened in the lordosis region by the longitudinal slots, supporting ribs which are integral with the backrest shell, but are flexurally elastic, being formed. The unslotted edge region of the backrest or backrest shell forms lateral lordosis edges, which are likewise flexurally elastic transversely with respect to the backrest height, which extends in the vertical direction, and, in the starting position, are likewise precurved toward the cushion side of the backrest.

The adjusting element may be guided in the central region of the lordosis support. However, the adjusting elements are expediently guided on the lordosis edge or on each lateral lordosis edge via guide elements, which are expediently integrally formed on the backrest shell. In the case of a preferred guidance on both sides of two adjusting elements in the transverse direction to the supporting ribs and therefore in the longitudinal direction of the backrest, when an individual adjusting member in the form of a worm gear, which can be actuated by means of a rotary knob and has a driven coil, is used, the adjusting element, which is guided on the lordosis edge facing the adjusting member, is guided directly to the adjusting member. The adjusting element guided on the opposite lordosis edge is then guided to the adjusting member via return guides provided in the lower region of the backrest.

The or each adjusting element, which is preferably designed in the form of a draw-in wire, is fastened on the upper side of the lordosis support, which side faces away from the adjusting member, to the backrest, expediently to the backrest shell thereof.

With regard to the chair having a backrest of this type, the abovementioned object is achieved according to the invention by the features of claim 7. For this purpose, the backrest is connected at its lower backrest end, which faces a seat surface which can be moved synchronously therewith, via a draw-in element, which is designed in an articulated manner, to the rear seat end of the seat surface, which end faces the backrest.

In an expedient refinement, the draw-in element is integrally formed on the backrest. In this case, the articulated connection of the backrest to the seat surface preferably takes place via a film hinge.

When the backrest is inclined to the rear, the draw-in element causes the lower side of the backrest to be drawn onto the seat surface, which is moved synchronously to the rear and downward together with the backrest. In order to enable, in a particularly simple and reliable manner, a relative movement between the backrest or, if appropriate, the backrest shell thereof relative to the backrest carrier carrying it, the backrest or the backrest shell is connected at the upper backrest end, which faces away from the seat surface, via a pendulum and/or rotary joint to the backrest carrier.

The advantages achieved by the invention are, in particular, that, firstly, the provision of a lordosis support which, in the starting state is precurved in a flexurally elastic manner on the cushion side and therefore in the cushioning direction of the backrest and, secondly, the guidance of the adjusting elements along the lordosis curvature again on the cushion side of the backrest mean that the adjusting elements can already be completely covered by the backrest cushion. As a result, the rear side of the backrest, which side faces away from the cushion side, is free of adjusting elements or adjusting members, so that the rear side of the backrest does not have to be concealed by additional screens.

By means of the provision of a backrest shell, which consists of plastic and the lordosis region of which is weakened in a targeted manner by means of longitudinal slots, with supporting ribs being formed, such that a flexurally elastic deformation of the lordosis region, which deformation can be obtained by means of the adjusting elements, is achieved, particularly simple manufacturing of the backrest for a chair with, at the same time, a reliable and virtually infinitely variably adjustable lordosis curvature, is made possible.

The connection of the lower backrest end via a draw-in element designed in an articulated manner has the advantage that the backrest, during the synchronizing movement, in addition to the movement about the pivot point between the seat surface and backrest carrier, at the same time oscillates about the connecting point between the backrest and the upper end of the backrest carrier. This gives rise to a combined movement which, relative to the seat or the seat surface, resembles a rotation about an assumed point that, in a ergonomically advantageous manner, is situated higher than the pivot point between the seat surface and backrest carrier.

Exemplary embodiments of the invention will be explained in more detail below with reference to a drawing, in which:

BRIEF DESCRIPTION OF THE DRAWINGS

Mutually corresponding parts are provided with the same reference numbers in all of the figures.

DESCRIPTION OF THE PREFERRED EMBODIMENTS

Figure 1:
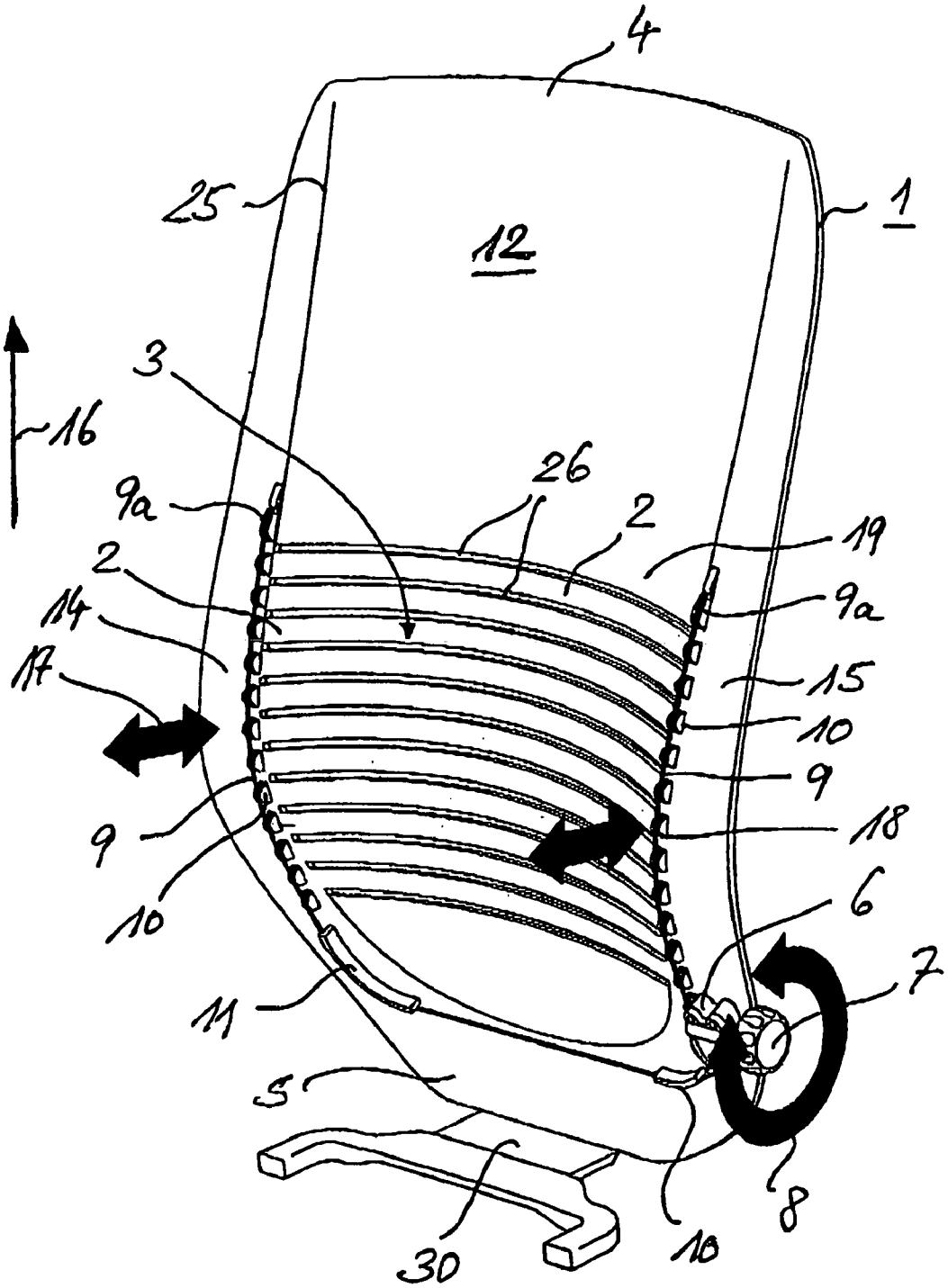
FIG. 1 shows, in a perspective illustration, a backrest according to the invention having a lordosis support which can be adjusted via an adjusting member

The backrest 1 illustrated in FIGS. 1 and 2 has a lordosis or lordosis support 3 formed from supporting ribs 2 arranged in a manner such that they run horizontally and parallel to one another. The lordosis support 3 is provided between an upper side 4 of the backrest and a lower side 5 of the backrest in the central to lower region of the backrest 1 and therefore in the region of a user's spinal column that is in the vicinity of the chest and pelvis.

In the region of the lower side 5 of the backrest, an adjusting member 6 which can be actuated by a rotary knob 7 is fastened to the backrest 1. Rotation of the rotary knob 7 in the rotational direction 8 causes an adjusting element 9, which is designed as draw-in wire in the present case, to be wound or unwound. The draw-in wire 9 is guided via a number of guide elements 10, 11. The guide elements 10, 11 are connected fixedly to the backrest 1 on the cushion side, which is referred to below as the curvature or front side 12 and faces a backrest cushion 13, which is illustrated by dashed lines in FIGS. 2*a* and 2*b*. The guide elements 11 are also used for retaining the draw-in wire 9 in the region of the lower side 5 of the backrest.

The guide elements 10 are arranged—with reference to FIG. 1—one above or below another in the longitudinal direction 16 of the backrest on the left backrest edge or lordosis edge 14 and on the right backrest edge or lordosis edge 15. In these edge regions, the supporting ribs 2 are connected to one another via the particular lordosis edge or backrest edge 14, 15. In this case, these backrest edge regions 14, 15, like the supporting ribs 2, are precurved in a flexurally elastic manner in the curvature or convex direction 17, i.e. toward the backrest cushion 13.

Figure 2B:
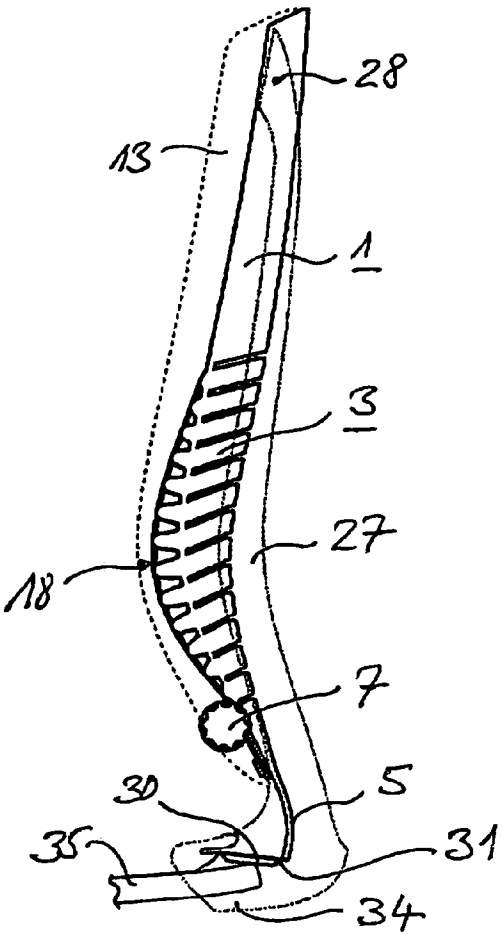
FIGS. 2*a* and 2*b* show, in a side view, the backrest according to FIG. 1 respectively having a precurved and straightened-out lordosis support.
Figure 2A:
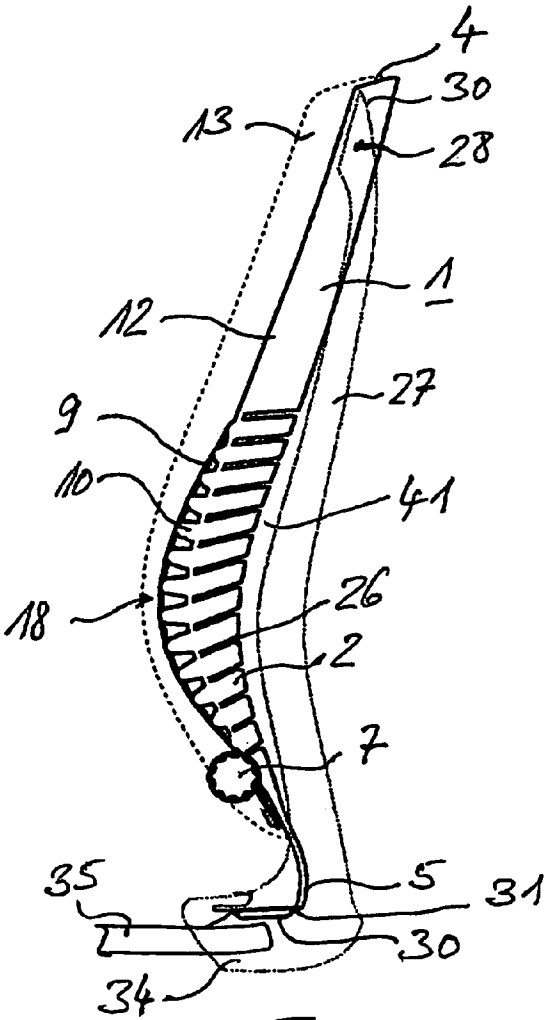

The drawing-in wire 9 is guided on the cushion side or front side 12 of the backrest 1. Rotation of the rotary knob 7 in the rotational direction 8 causes the draw-in wire 9 to be subjected to an increasing tensile load. In this case, starting from the starting position illustrated in FIG. 2*a* with, for example, maximum lordosis curvature of the convexly precurved lordosis support 3 the adjusting element 9 is increasingly shortened. As a result, the lordosis curvature 18 decreases from the starting position illustrated in FIG. 2*a* as far as the end position, which is shown in FIG. 2*b*, is comparatively slightly precurved and in which the backrest 1 is at least approximately straightened out. In this case, the or each draw-in wire 9 is fixed in the region of the lordosis upper side 19 by its wire end 9*a* which is there to the backrest 1.

Figure 3:
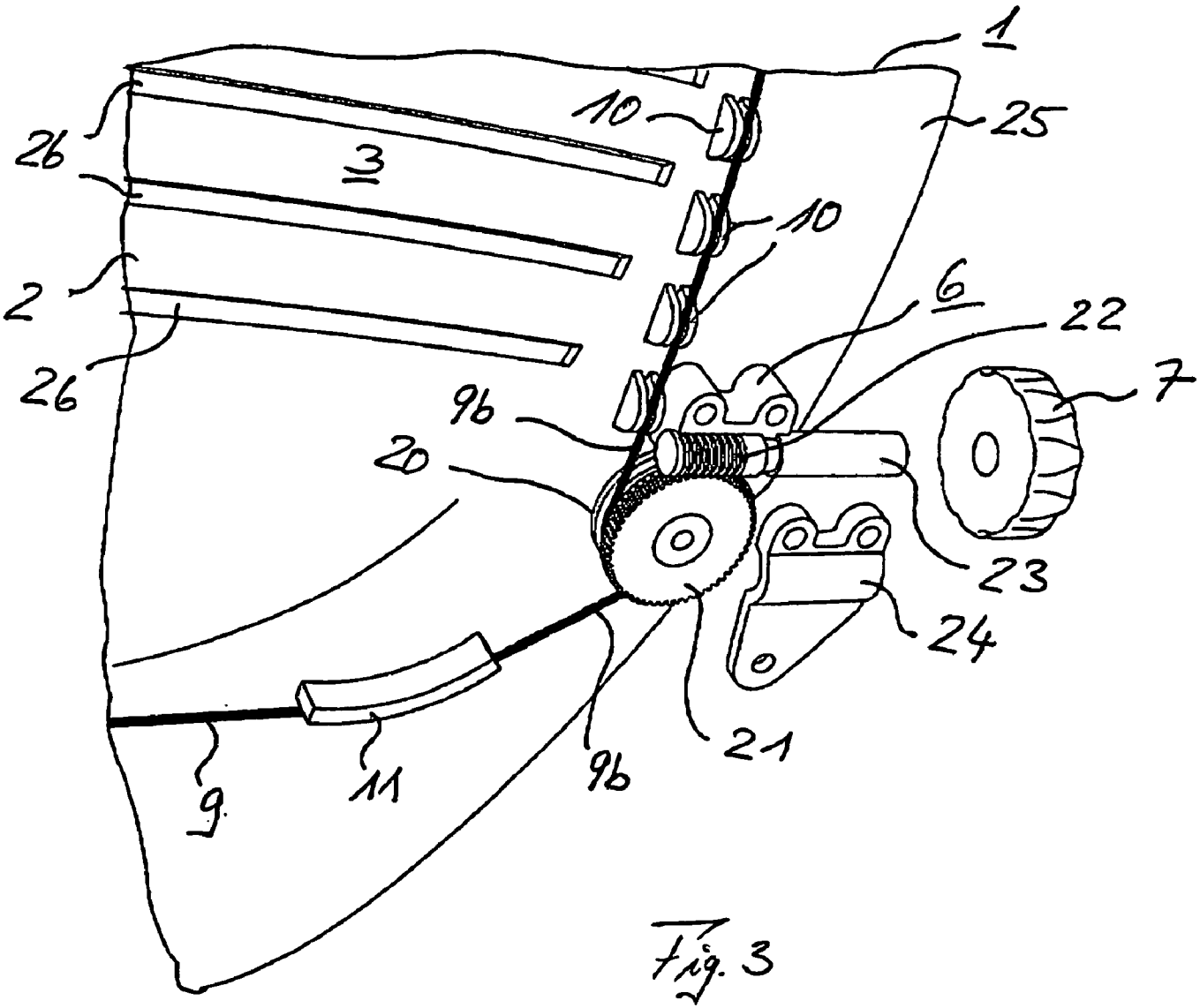
FIG. 3 shows the adjusting member in an enlarged exploded illustration.

As can be seen from FIG. 3, the respective opposite wire end 9*b* of the draw-in wire 9 is wound up onto a coil 20 of the adjusting member 6. The coil 20 is connected fixedly to a toothed wheel or wormwheel 21 which engages in a worm 22. The rotary knob 7 can be placed in a form-fitting and frictional manner onto a worm shaft 23, which is designed as an extension of the worm 22. The worm gear formed by the wormwheel 21 and the worm 22 is fixed to the backrest 1 by means of a covering flange 24.

The lordosis support 3 is integrated integrally into the backrest 1. For this purpose, the backrest 1 is formed from a backrest shell 25, which consists of synthetic material and in the region of which which is assigned to the lordosis support 3 longitudinal slots 26 running horizontally are made. In each case one of the supporting ribs 2 of the lordosis support 3 is formed between in each case two of these longitudinal slots 26. The backrest 1 with the integrated lordosis support 3 can therefore be produced in a particularly simple manner, for example by injection molding. In the edge region 14, 15 of the lordosis support 3, the guide elements 10, 11 are also integrally formed on the backrest shell 26.

As is apparent from FIGS. 2 and 4, the backrest 1 or the backrest shell 25 is held on the edge side by backrest carriers 27. In this case, the mounting on the upper side 4 of the backrest is realized via a pendulum joint and/or rotary joint 28 between the upper carrier end 29 which is there and the backrest 1. On the opposite lower side 5 of the backrest, a draw-in element 30 is integrally formed on the backrest shell 26, preferably via a joint or a hinge 31. In this case, the joint 31 is expediently designed as a film hinge.

Figures 4A, 4B:
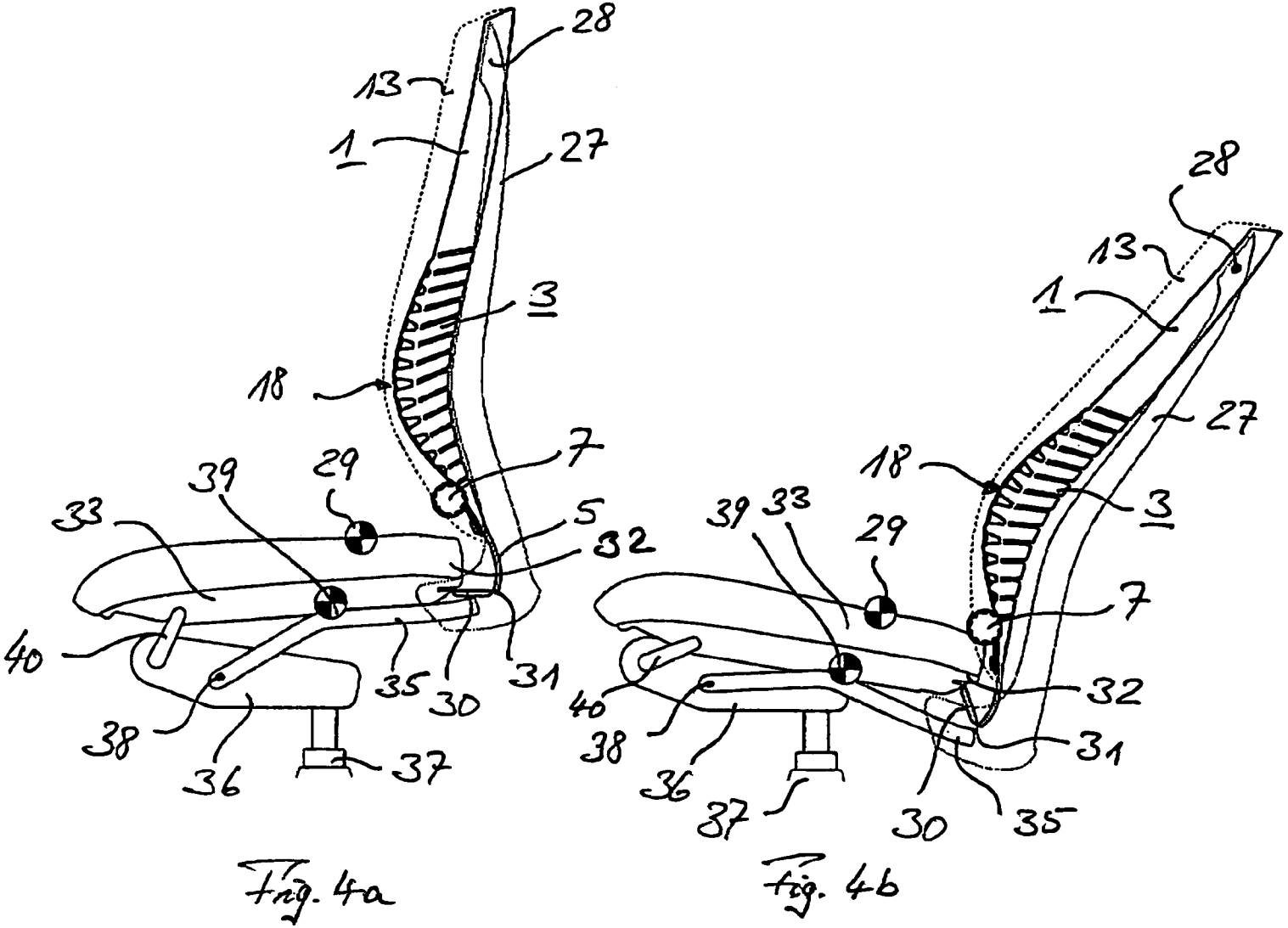
FIGS. 4*a* and 4*b* show a chair with a seat surface and a backrest according to FIG. 1, connected thereto via a draw-in element, in the starting position and in the end position inclined to the rear.

Via this draw-in element 30, the backrest 1 or the backrest shell 26 can be connected fixedly by its lower backrest side 5 to the rear seat end 32 of a seat surface 33 of the chair illustrated in FIGS. 4*a* and 4*b*. The backrest carrier 27 merges at its lower carrier end or carrying limb 34, which faces away from the pendulum/rotary joint 28, into a backrest guide bar 35 or is connected, for example integrally, to the latter. The backrest guide bar 35, which constitutes an extension of the backrest carrier 27, is connected to a seat carrier 36 which, for its part, is connected to a static foot 37 (only part of which is illustrated). The connection of the backrest carrier 27 in its extension via the backrest guide bar 35 to the seat carrier 36 takes place via a first rotary joint 38. A second rotary joint 39 is provided between the backrest guide bar 35 and the seat surface 33. A seat guide bar 40, which is provided in the front region of the seat surface 33, produces a rotatable and slidable connection between the seat carrier 36 and the seat surface 33.

When the backrest is inclined from the starting position illustrated in FIG. 4*a* into the inclination position illustrated in FIG. 4*b*, the seat surface 33 is moved at the same time rearward and downward synchronously with the backrest 1. At the same time, the lower side 5 of the backrest 1 is drawn forward in the direction of the seat surface 33 via the draw-in element 30. The oscillating or rotational movement required for this takes place via the pendulum/rotary joint 28 between the backrest carrier 27 and the backrest 1, on the upper side 4 thereof. The setting of the lordosis support 3, i.e. the degree of its lordosis curvature 18, can be set here in every synchronizing position of the chair.

As a consequence of the articulated connection of the lower backrest end or carrier end 34 via the draw-in element 31 to the seat surface 33, the backrest 1, during the synchronizing movement, in addition to the movement about the pivot point 39 between the seat surface 33 and the backrest carrier 27, at the same time oscillates about the connecting point in the form of the joint 28 between the backrest 1 and the upper end of the backrest carrier 27. The resultant combined movement resembles a rotation about an assumed point 29 relative to the seat surface 33. This virtual pivot point 29 is situated, in an ergonomically advantageous manner, higher than the pivot point 39 between the seat surface 33 and the backrest carrier 27.

It is particular advantageous here for the adjusting element 9 of the lordosis support 3 in the form of the draw-in wires (illustrated by way of example) and the guide elements 10, 11, which are provided for guiding them, to be completely covered by the backrest cushion 13 in the final installation state. Additional covering elements, in particular on the rear side 41 of the backrest 1, which side faces away from the front side 12, are therefore not required, since no adjusting elements of the lordosis support 3 whatsoever are to be provided there.

We claim:

1. A backrest, comprising:

a lordosis support having supporting ribs disposed in mutually parallel relationship and connected along a lateral lordosis edge, said supporting ribs being disposed, in a starting position thereof, precurved and flexurally elastic;

an adjusting element guided on said lateral lordosis edge, and an adjusting member disposed to actuate said adjusting element, for setting a lordosis curvature of said lordosis support, said adjusting element being guided on a curvature side of said lordosis support such that the lordosis curvature decreases upon a tensile loading of said adjusting element.

2. The backrest according to claim 1, wherein said lordosis support is configured as a lower back support of an office chair.

3. The backrest according to claim 1, wherein said supporting ribs are integrated integrally into a backrest shell.

4. The backrest according to claim 1, wherein said adjusting element is guided on both sides of said lordosis support.

5. The backrest according to claim 1, wherein said adjusting element is a tension cable disposed to be selectively drawn in and released by said adjusting member.

6. The backrest according to claim 1, which comprises guide elements for said adjusting element, said guide elements being integrally formed on the curvature side.

7. A backrest, comprising:

a lordosis support having supporting ribs disposed in mutually parallel relationship, and disposed, in a starting position thereof, precurved and flexurally elastic;

an adjusting element, and an adjusting member disposed to actuate said adjusting element, for setting a lordosis curvature of said lordosis support, said adjusting element being guided on a curvature side of said lordosis support such that the lordosis curvature decreases upon a tensile loading of said adjusting element;

wherein said adjusting element is a tension cable and said adjusting member is a roller pulley for selectively winding and unwinding said tension cable.

8. A chair, comprising:

a seat carrier and a backrest carrier articulated to said seat carrier;

a backrest according to claim 1 coupled to said seat carrier via said backrest carrier;

a seat surface disposed on said seat carrier to be movable synchronously with said backrest;

a draw-in element having an articulated configuration, said draw-in element connecting said backrest, via a lower backrest end facing towards said seat surface, to said seat surface, at a rear seat end of said seat surface facing said backrest.

9. The chair according to claim 8 configured as an office chair.

10. The chair according to claim 8, wherein said draw-in element is integrally formed on said backrest.

11. The chair according to claim 8, wherein said draw-in element is configured to be articulated via a film hinge.

12. The chair according to claim 8, which comprises at least one of a pendulum and a rotary joint connecting an upper backrest end of said backrest, distal from said seat surface, to said backrest carrier.

* * * * *